US012575609B2

(12) United States Patent
Bessant et al.

(10) Patent No.: US 12,575,609 B2
(45) Date of Patent: Mar. 17, 2026

(54) HEATER TUBE WITH THERMAL INSULATION AND ELECTRICAL ISOLATION

(71) Applicant: Philip Morris Products S.A., Neuchatel (CH)

(72) Inventors: Michel Bessant, Neuchatel (CH); Silviu Natanael Pantea, Neuchatel (CH); Johannes Petrus Maria Pijnenburg, Neuchatel (CH); Jun Wei Yim, Colombier (CH); Grégori Ischi, Bole (CH); Marco Dell'anna, Treviso (IT); Stefano Piccin, Vittorio Veneto (IT); Omar Rispoli, Colle Umberto (IT); Sandro Sartor, San Fior (IT)

(73) Assignee: Philip Morris Products S.A., Neuchatel (CH)

( * ) Notice: Subject to any disclaimer, the term of this patent is extended or adjusted under 35 U.S.C. 154(b) by 400 days.

(21) Appl. No.: 18/250,286

(22) PCT Filed: Oct. 25, 2021

(86) PCT No.: PCT/EP2021/079540
§ 371 (c)(1),
(2) Date: Apr. 24, 2023

(87) PCT Pub. No.: WO2022/090156
PCT Pub. Date: May 5, 2022

(65) Prior Publication Data

US 2023/0397665 A1 Dec. 14, 2023

(30) Foreign Application Priority Data

Oct. 28, 2020 (EP) ..... 20204490

(51) Int. Cl.
*A24F 40/46* (2020.01)
*A24F 40/51* (2020.01)
*A24F 40/70* (2020.01)

(52) U.S. Cl.
CPC ..... *A24F 40/46* (2020.01); *A24F 40/51* (2020.01); *A24F 40/70* (2020.01)

(58) Field of Classification Search
None
See application file for complete search history.

(56) References Cited

U.S. PATENT DOCUMENTS

2011/0126848 A1 6/2011 Zuber et al.
2015/0272226 A1 10/2015 Zuber et al.
(Continued)

FOREIGN PATENT DOCUMENTS

CN 104799438 A 7/2015
CN 111053298 A 4/2020
(Continued)

OTHER PUBLICATIONS

Translation of KR 20200109705 (Year: 2020).*
(Continued)

*Primary Examiner* — Cynthia Szewczyk
(74) *Attorney, Agent, or Firm* — Oblon, McClelland, Maier & Neustadt, L.L.P.

(57) ABSTRACT

A heating assembly for an aerosol-generating device is provided, the heating assembly including: a substrate layer that is an electrically isolating substrate layer; and a heating element arranged on a first portion of the substrate layer, the substrate layer including a second portion on which the heating element is not disposed, the substrate layer being rolled into a tubular shape, such that the first portion of the substrate layer is positioned as an inner layer, the second portion of the substrate layer being positioned as an outer
(Continued)

layer surrounding the first portion of the substrate layer, and the heating element being arranged between the first portion of the substrate layer and the second portion of the substrate layer.

19 Claims, 5 Drawing Sheets

(56) References Cited

U.S. PATENT DOCUMENTS

| | | | | |
|---|---|---|---|---|
| 2016/0174613 | A1 | 6/2016 | Zuber et al. | |
| 2020/0404969 | A1 | 12/2020 | Zuber et al. | |
| 2022/0312843 | A1 * | 10/2022 | Reevell | A24F 40/57 |

FOREIGN PATENT DOCUMENTS

| | | | | |
|---|---|---|---|---|
| EP | 2 327 318 | A1 | 6/2011 | |
| JP | 2013-511962 | A | 4/2013 | |
| KR | 10-2017004 | B1 | 9/2019 | |
| KR | 20200109705 | A * | 9/2020 | A24F 40/46 |
| RU | 2014 138 085 | A | 4/2016 | |
| RU | 2 692 784 | C2 | 6/2019 | |
| WO | WO 2018/194291 | A2 | 10/2018 | |
| WO | WO 2019/017654 | A2 | 1/2019 | |
| WO | WO 2019/154919 | A1 | 8/2019 | |

OTHER PUBLICATIONS

International Search Report & Written Opinion issued Feb. 24, 2022 in PCT/EP2021/079540, filed on Oct. 25, 2021 11 pages.

Japanese Office Action issued on May 14, 2024 in Japanese Patent Application No. 2023-516712 (with unedited computer-generated English translation), 10 pages.

Combined Russian Office Action and Search Report issued Sep. 27, 2023 in Russian Patent Application No. 2023113604/07 (with English Translation), 17 pages.

Japanese Decision to Grant issued Jan. 30, 2025, in corresponding Japanese Patent Application No. 2023-516712, 2 pages.

International Preliminary Report on Patentability and Written Opinion issued May 2, 2023 in PCT/EP2021/079540, 7 pages.

Combined Chinese Office Action and Search Report issued Oct. 30, 2025, in corresponding Chinese Patent Application No. 202180065063.3, 5 pages.

Korean Notice of Allowance issued on Sep. 20, 2025 in Korean Patent Application No. 10-2023-7014020 (with English translation), 5 pages.

* cited by examiner

HEATER TUBE WITH THERMAL INSULATION AND ELECTRICAL ISOLATION

The present invention relates to a heating assembly for an aerosol-generating device. The present invention further relates to an aerosol-generating device. The present disclosure further relates to an aerosol-generating system comprising an aerosol-generating device and an aerosol-forming substrate.

It is known to provide an aerosol-generating device for generating an inhalable vapor. Such devices may heat an aerosol-forming substrate contained in an aerosol-generating article without burning the aerosol-forming substrate. The aerosol-generating article may have a rod shape for insertion of the aerosol-generating article into a heating chamber of the aerosol-generating device. A heating element of a heating assembly is typically arranged in or around the heating chamber for heating the aerosol-forming substrate once the aerosol-generating article is inserted into the heating chamber of the aerosol-generating device.

Heat produced by the heating element may inadvertently be dissipated to components of the device that are not intended to be heated. Generally, heat dissipation away from the heating chamber may cause heat losses within the heating chamber resulting in a less efficient heating. An excess amount of energy may be required to heat the heating chamber to a desired temperature. At the same time, the heating element has to be electrically isolated from the heating chamber to prevent a short-circuit of the heating element.

It would be desirable to have a heating assembly for an aerosol-generating device that may reduce heat losses from the heating chamber. It would be desirable to have a heating assembly that may reduce heating up of the outer housing of the device to be grasped by a user. It would be desirable to have a heating assembly that may provide effective thermal insulation. It would be desirable to have a heating assembly that may provide thermal insulation at low manufacturing costs. It would be desirable to have the heating assembly that may electrically isolate a heating element of the heating assembly from the heating chamber. It would be desirable to have a heating assembly with optimized thermal insulation and optimized electrical isolation at low manufacturing costs. It would be desirable to have a heating assembly that may provide thermal insulation and electrical isolation at the same time.

According to an embodiment of the invention there is provided a heating assembly for an aerosol-generating device. The heating assembly may comprise a substrate layer. The substrate layer may be an electrically isolating substrate layer. The heating assembly may comprise a heating element. The heating element may be arranged on a first portion of the substrate layer. The substrate layer may comprise a second portion, on which the heating element is not disposed. The substrate layer may be rolled into a tubular shape, such that the first portion of the substrate layer may be positioned as an inner layer. The second portion of the substrate layer may be positioned as an outer layer surrounding the first portion of the substrate layer. The heating element may be arranged between the first portion of the substrate layer and the second portion of the substrate layer.

According to an embodiment of the invention there is provided a heating assembly for an aerosol-generating device. The heating assembly comprises a substrate layer. The substrate layer is an electrically isolating substrate layer. The heating assembly further comprises a heating element.

The heating element is arranged on a first portion of the substrate layer. The substrate layer further comprises a second portion, on which the heating element is not disposed. The substrate layer is rolled into a tubular shape, such that the first portion of the substrate layer is positioned as an inner layer. The second portion of the substrate layer is positioned as an outer layer surrounding the first portion of the substrate layer. The heating element is arranged between the first portion of the substrate layer and the second portion of the substrate layer.

By providing a substrate layer with a first portion and a second portion, a single substrate layer can be used to sandwich the heating element between the two portions of the substrate layer. As a consequence, the heating element is protected by the portions of the substrate layer. There is no longer a necessity for a separate inner layer or a separate outer layer. Protection of the heating element such as one or both of thermal protection from the outside and electrical isolation from the inside can be achieved by a single substrate layer having the configuration according to the invention described herein. Manufacturing costs may be reduced by using a single substrate layer. Manufacturing may be simplified by using a single substrate layer.

The electrically isolating substrate layer may be made from polyimide. The substrate layer may be configured to withstand between 220° C. and 320° C., preferably between 240° C. and 300° C., preferably around 280° C. The substrate layer may be made from Pyralux.

The substrate layer may be flexible. A flexible substrate layer has the advantage that the substrate layer can be rolled or formed into a desired shape. The desired shape is preferably a tubular shape. Due to the flexibility of the substrate layer, the first portion of the substrate layer can be rolled as a first step followed by rolling the second portion of the substrate layer around the first portion as a second step. Due to the flexibility of the substrate layer, the first portion of the substrate layer can conform to the desired tubular shape during the first step. Due to the flexibility of the substrate layer, the second portion of the substrate layer can conform to the tubular-shaped first portion of the substrate layer during rolling the second portion of the substrate layer around the first portion of the substrate layer in the second step.

The substrate layer may be provided as a sheet before being rolled into the tubular shape. The substrate layer may be provided as a planar sheet before being rolled into the tubular shape. The substrate layer may be provided as a rectangular sheet before being rolled into the tubular shape. Such a sheet-shaped substrate layer may be readily available and therefore reduce manufacturing costs.

The substrate layer may have a length that is larger than the width of the substrate layer before being rolled into the tubular shape. The substrate layer may have a length that may be approximately two times the width of the substrate layer before being rolled into the tubular shape. Alternatively, the substrate layer may have a length that is smaller than the width of the substrate layer before being rolled into the tubular shape. The length and the width of the substrate layer may be chosen depending upon one or both of the diameter and of the aerosol-generating article to be heated and the substrate portion length of the article. The length of the substrate layer refers to the length along the longitudinal axis of the substrate layer before rolling the substrate layer into the tubular shape. The width of the substrate layer refers to the width measured perpendicular to the longitudinal axis of the substrate layer and in the plane of the substrate layer before the substrate layer is rolled into the tubular shape.

The substrate layer may have a length that is two times the circumference of the tube of the heating arrangement described in more detail below.

More generally, the length of the substrate layer may be chosen such that the second portion of the substrate layer can fully surround the first portion of the substrate layer during rolling the second portion of the substrate layer around the first portion of the substrate layer.

The length of the first portion of the substrate layer may be identical or similar to the width of the first portion of the substrate layer. The length of the second portion of the substrate layer may be identical or similar to the width of the second portion of the substrate layer. The dimensions of the first portion of the substrate layer may be identical or similar to the dimensions of the second portion of the substrate layer. The length and width of the first portion of the substrate layer may be identical or similar to the length and width of the second portion of the substrate layer.

The surface area of the second portion of the substrate layer may be equal to or greater than the surface area of the first portion of the substrate layer. The surface area of the third surface of the second portion of the substrate layer may be equal to or greater than the surface area of the second surface of the first portion of the substrate layer.

After rolling of the substrate layer, the outer diameter of the first portion of the substrate layer may correspond to the inner diameter of the second portion of the substrate layer.

The heating element may comprise heating tracks. The heating tracks may be configured to generate heat. The heating tracks may be electrically resistive heating tracks. The heating elements may comprise electrical contacts for electrically contacting the heating tracks. The electrical contacts may be attached to the heating tracks by any known means, exemplarily by soldering or welding. A first electrical contact may be attached to a first end of the heating tracks and a second electrical contact may be attached to a second end of the heating tracks. The first end of the heating tracks may be a proximal end of the heating tracks and the second end of the heating tracks may be a distal end of the heating tracks or vice versa.

The heating tracks may be made from stainless steel. The heating tracks may be made from stainless-steel at about 50 μm thickness. The heating tracks may be preferably made from stainless-steel at about 25 μm thickness. The heating tracks may be made from inconel at about 50.8 μm thickness. The heating tracks may be made from inconel at about 25.4 μm thickness. The heating tracks may be made from copper at about 35 μm thickness. The heating tracks may be made from constantan at about 25 μm thickness. The heating tracks may be made from nickel at about 12 μm thickness. The heating tracks may be made from brass at about 25 μm thickness.

The heating tracks may be photo-printed on the substrate layer. The heating tracks may be chemically etched on the substrate layer.

The term 'heating tracks' encompasses a single heating track. The heating element or the heating tracks may be printed on the first portion of the substrate layer.

The heating tracks may be centrally arranged on the first portion of the substrate layer. The heating tracks may have a bench shape. The heating tracks may have a curved shape. The heating tracks may be flat before the substrate layer is rolled into the tubular shape. The heating tracks or the heating element may be flexible. The heating tracks or the heating element may conform to the tubular shape of the substrate layer when the substrate layer is rolled into the tubular shape.

The heating element may be sandwiched between the first portion of the substrate layer the second portion of the substrate layer. After rolling of the substrate layer, the first portion of the substrate layer may be arranged inwards of the heating element in the axial direction. After rolling of the substrate layer, the second portion of the substrate layer may be arranged outwards of the heating element in the axial direction.

The first portion of the substrate layer may electrically isolate the heating element from the inside of the tube formed by the tubular shaped substrate layer.

The heating arrangement may comprise a tube, preferably a metal tube, around which the substrate layer may be wrapped or rolled. The metal tube is preferable a stainless steel tube. Alternatively, the tube may be a ceramic tube. The tube may define the tubular shape of the heating arrangement. The outer diameter of the tube may correspond to the inner diameter of the first portion of the substrate layer after rolling of the substrate layer.

As an alternative, the tube may be formed by providing a metal layer on the first portion of the substrate layer on the opposite side of the heating element in a way that the tube is formed when rolling the substrate layer. Generally, the rolling of the substrate layer may be facilitated by rolling the substrate layer around a temporary cylindrical or conical support element. As a further alternative, the first portion of the substrate layer may be made of PEEK, which may form the tube directly.

The second portion of the substrate layer may thermally insulate the heating element from an environment outside of the tube formed by the tubular shaped substrate layer. In other words, the second portion of the substrate layer may thermally insulate the heating element from an environment outside of the heating assembly.

The heating assembly may comprise only a single substrate layer. The heating assembly may comprise no separate thermal insulation layer. Preferably, the substrate layer has a double functionality of electrically isolating the heating element from the tube that is surrounded by the first portion of the substrate layer and the substrate layer is thermally insulating the heating element from an environment outside of the heating assembly. Since both of these functionalities can be fulfilled by a single substrate layer, a structurally simple heating assembly is provided reducing manufacturing costs while improving the functionality of the heating assembly.

The heating assembly may further comprise a heating chamber formed by the tube. The substrate layer may be rolled at least twice around the heating chamber, preferably, around the outside of the heating chamber. Rolling the substrate layer for the first time around the heating chamber means that the first portion of the substrate layer is rolled around the heating chamber. Rolling the substrate layer for the second time around the heating chamber means that the second portion of the substrate layer is rolled around the first portion of the substrate layer.

The tube may be made from stainless steel. The tube may have a length of between 10 mm and 35 mm, preferably between 12 mm and 30 mm, preferably between 13 mm and 22 mm. The tube may be a hollow tube. The hollow tube may have an internal diameter of between 4 mm and 9 mm, preferably between 5 mm and 6 mm or between 6.8 mm and 7.5 mm, preferably around 5.35 mm or around 7.3 mm. The tube may have a thickness of between 70 μm and 110 μm, preferably between 80 μm and 100 μm, preferably around 90 μm. The tube may have a cylindrical cross-section. The tube may have a circular cross-section.

The first portion of the substrate layer may comprise a first surface and an opposite second surface. The first surface of the first portion of the substrate layer may be arranged in direct contact with the heating chamber. The second surface of the first portion of the substrate layer may be in direct contact with the heating element. The second surface of the first portion of the substrate layer may be in direct contact with the second portion of the substrate layer.

Similarly, the second portion of the substrate layer may comprise a third surface and an opposite fourth surface. The third surface of the second portion of the substrate layer may be arranged in direct contact with the heating element. The third surface of the second portion of the substrate layer may be arranged in direct contact with the second surface of the first portion of the substrate layer. The fourth surface of the second portion of the substrate layer may form the outer surface of the heating arrangement.

One or more of the second portion of the substrate layer and the heating element may be arranged distanced from the heating chamber by the first portion of the substrate layer.

The length of the first portion of the substrate layer may be equal to or less than the circumference of the tube. The first portion may fully wrap around the tube. The first portion may wrap around the tube once such that the surface of the tube is, by the first portion of the substrate layer after the first portion of the substrate layer has been wrapped around the tube. The length of the second portion of the substrate layer may be equal to the circumference of the first portion of the substrate layer, so that the second portion may wrap over the heating element and the first portion.

The circumference of the heating chamber may be around half the length of the substrate layer. The circumference of the heating chamber may be equal to the circumference of the tube forming the heating chamber.

The first portion of the substrate layer may have a length equal to or less than the circumference of the tube. The second portion of the substrate layer may have a circumference equal to or more than the circumference of the tube, so that it may wrap around the circumference of one or both of the tube and the first portion of the substrate layer at least once. The second portion of the substrate layer may have a circumference equal to or more than the circumference of the first portion of the substrate layer, so that it may wrap around the circumference of one or both of the tube and the first portion at least once.

The tube of the heating chamber may have a thickness of between 70 μm and 110 μm, preferably between 80 μm and 100 μm, preferably around 90 μm.

The heating assembly may further comprise a temperature sensor. The temperature sensor may be an NTC, a Pt100 or preferably a Pt1000 temperature sensor. The temperature sensor may be welded to the heater. The temperature sensor may be provided with connections. The temperature sensor may be provided with metal connections. Connections, preferably stainless steel connections, may be etched directly on the substrate layer. Then the temperature sensor metallic connections may be welded on the stainless-steel connections of the substrate layer. This allows a simple manufacturing process. An exemplary manufacturing process is described in the following. The substrate layer may be laminated with a sheet of stainless-steel, this creates a "sandwich" made of two layers, the bottom one is polyimide, the top one is the stainless-steel sheet. Then, the heating-tracks may be photo-printed on the first portion of this sandwich (on the stainless-steel side), and at the same time, the second portion of this sandwich (on the stainless-steel side) may be photo-printed with electrical connections for the temperature sensor; so both the heating tracks and the electrical connections of the temperature sensor may be photo-printed at the same time. Then, the full sandwich may be chemically etched (polyimide is resisting to the chemical etching, so only the stainless-steel is being etched), so that both heating tracks and stainless-steel connections for the temperature sensor (here, we speak about the connections on the sandwich) may be etched at the same time with the same process. Then, at a later assembly stage, the temperature sensor metallic connections (it can be copper, or something else) may be welded on the stainless-steel connections sitting on the surface of the "flexible heater sandwich" on its second portion.

The temperature sensor may be arranged on an outer surface of the second portion of the substrate layer. The temperature sensor may be arranged adjacent the heating element and separated from the heating element by the second portion of the substrate layer.

The temperature sensor may be positioned on the second portion such that when the substrate layer is rolled up, the temperature sensor may be positioned in area corresponding to the centre of the first portion. By positioning the temperature sensor in this way, the heating element may be mapping the temperature sensor so that the temperature sensor is positioned adjacent the hottest part of the heating element. The hottest part adjacent the temperature sensor may be the centre of the first portion. The heating element may be arranged at the center of the first portion. The temperature sensor may be arranged directly adjacent the heating element only distanced from the heating element by the thickness of the second portion of the substrate layer. The temperature sensor may be aligned precisely with the hottest point of the heating tracks after thermal imaging of the full assembly identifying this hottest point and defining the mechanical position of this hottest point. This information may then be feedbacked to the heating assembly design, allowing a very precise alignment of the temperature sensor.

One or both of an adhesive layer and a glue layer may be provided on the first surface of the first portion of the substrate layer. In other words, the adhesive layer or glue layer may be provided on the surface of the first portion opposite the side on which the heating element may be arranged. The adhesive layer or the glue layer may be configured to securely hold the first portion of the substrate layer on the outer circumference of the tube.

The adhesive layer may have a thickness of between 15 μm and 50 μm, preferably between 20 μm and 30 μm, more preferably around 25 μm.

The adhesive layer may be a silicon-based adhesive layer. The adhesive layer may comprise one or both of PEEK-based adhesives and acrylic adhesives.

One or both of an adhesive layer and a glue layer may be provided on the third surface of the second portion of the substrate layer. This adhesive layer or glue layer may be configured to securely hold the second portion of the substrate layer on the first portion of the substrate layer.

A heat shrink layer may be arranged around the heating assembly when the heating assembly is rolled into the tubular shape. The heat shrink layer may be configured to shrink when heated supply to the heat shrink layer. The heat shrink layer may securely hold the heating assembly together. The heat shrink layer may be configured to apply a uniform inwards pressure to the heating assembly. The heat shrink layer may improve the contact between one or both of the tube and the first portion of the substrate layer and the first portion of the substrate layer and the second portion of the substrate layer. The heat shrink layer may hold most or all components of the heating assembly tight together. The heat shrink layer may be employed to replace the glue layers or adhesive layers described herein. Alternatively, the heat shrink layer may be employed in addition to the glue layers or adhesive layers described herein.

The thickness of the heat shrink layer may be between 100 μm and 300 μm, preferably around 180 μm.

The heat shrink layer may be made of PEEK. The heat shrink layer may be made of or comprise one or more of Teflon and PTFE.

The substrate layer may have a thickness of between 15 μm and 50 μm, preferably between 20 μm and 30 μm, more preferably around 25 μm.

The heating element may, when preferably made of stainless steel, have a thickness of between 12 μm and 60 μm, preferably between 45 μm and 55 μm, more preferably around 50 μm. The heating tracks may, when preferably made of stainless steel, have a thickness of between 12 μm and 60 μm, preferably between 45 μm and 55 μm, more preferably around 50 μm. The heating element may, when made of brass, have a thickness of between 20 μm and 30 μm, preferably around 25 μm. The heating tracks may, when preferably made of brass, have a thickness of between 20 μm and 30 μm, preferably around 25 μm.

The invention further relates to an aerosol-generating device comprising a heating assembly as described herein.

The invention further relates to an aerosol generating system comprising an aerosol-generating device as described herein and an aerosol-generating article comprising aerosol-forming substrate as described herein.

A proximal end of the heating assembly according to the invention is configured to be arranged within an aerosol-generating device in a direction towards the mouth end or downstream end of the device. A distal end of the heating assembly according to the invention is configured to be arranged within an aerosol-generating device in a direction towards the distal end or upstream end of the device.

As used herein, the terms "upstream" and "downstream", are used to describe the relative positions of components, or portions of components, of the aerosol generating device in relation to the direction in which airflows through the aerosol generating device during use thereof. Aerosol generating devices according to the invention comprise a proximal end through which, in use, an aerosol exits the device. The proximal end of the aerosol generating device may also be referred to as the mouth end or the downstream end. The mouth end is downstream of the distal end. The distal end of the aerosol generating article may also be referred to as the upstream end. Components, or portions of components, of the aerosol generating device may be described as being upstream or downstream of one another based on their relative positions with respect to the airflow path of the aerosol generating device.

In all of the aspects of the disclosure, the heating element may comprise an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics.

As described, in any of the aspects of the disclosure, the heating element may comprise an external heating element, where "external" refers to the aerosol-forming substrate. An external heating element may take any suitable form. For example, an external heating element may take the form of one or more flexible heating foils or heating tracks on a dielectric substrate, such as polyimide. The dielectric substrate is the substrate layer. The flexible heating foils or heating tracks can be shaped to conform to the perimeter of the heating chamber. Alternatively, an external heating element may take the form of a metallic grid or grids, a flexible printed circuit board, a molded interconnect device (MID), ceramic heater, flexible carbon fibre heater or may be formed using a coating technique, such as plasma vapour deposition, on the suitable shaped substrate layer. An external heating element may also be formed using a metal having a defined relationship between temperature and resistivity. In such an exemplary device, the metal may be formed as a track between the first portion of the substrate layer and the second portion of the substrate layer. An external heating element formed in this manner may be used to both heat and monitor the temperature of the external heating element during operation.

The heating element advantageously heats the aerosol-forming substrate by means of conduction. Alternatively, the heat from either an internal or external heating element may be conducted to the substrate by means of a heat conductive element.

During operation, the aerosol-forming substrate may be completely contained within the aerosol-generating device. In that case, a user may puff on a mouthpiece of the aerosol-generating device. Alternatively, during operation a smoking article containing the aerosol-forming substrate may be partially contained within the aerosol-generating device. In that case, the user may puff directly on the smoking article.

The heating element may be configured as an induction heating element. The induction heating element may comprise an induction coil and a susceptor. In general, a susceptor is a material that is capable of generating heat, when penetrated by an alternating magnetic field. According to the invention, the susceptor may be electrically conductive or magnetic or both electrically conductive and magnetic. An alternating magnetic field generated by one or several induction coils heat the susceptor, which then transfers the heat to the aerosol-forming substrate, such that an aerosol is formed. The heat transfer may be mainly by conduction of heat. Such a transfer of heat is best, if the susceptor is in close thermal contact with the aerosol-forming substrate. When an induction heating element is employed, the induction heating element may be configured as an external heater as described herein. If the induction heating element is configured as an external heating element, the susceptor element is preferably configured as a cylindrical susceptor at least partly surrounding the heating chamber. The heating tracks described herein may be configured as a susceptor. The susceptor may be arranged between the first portion of the substrate layer and the second portion of the substrate layer. The second portion of the substrate layer may be surrounded by the induction coil. The susceptor as well as the induction coil may be part of the heating assembly.

Preferably, the aerosol-generating device comprises a power supply configured to supply power to the one or both of the heating element and the heating assembly. The power supply preferably comprises a power source. Preferably, the power source is a battery, such as a lithium ion battery. As an alternative, the power source may be another form of charge storage device such as a capacitor. The power source may require recharging. For example, the power source may have sufficient capacity to allow for the continuous generation of aerosol for a period of around six minutes or for a period that is a multiple of six minutes. In another example, the power source may have sufficient capacity to allow for a predetermined number of puffs or discrete activations of the heating assembly.

The power supply may comprise control electronics. The control electronics may comprise a microcontroller. The microcontroller is preferably a programmable microcontroller. The electric circuitry may comprise further electronic components. The electric circuitry may be configured to regulate a supply of power to the heating assembly. Power may be supplied to the heating assembly continuously following activation of the system or may be supplied intermittently, such as on a puff-by-puff basis. The power may be supplied to the heating assembly in the form of pulses of electrical current.

As used herein, the term "aerosol-forming substrate" refers to a substrate capable of releasing volatile compounds that can form an aerosol. The volatile compounds may be released by heating or combusting the aerosol-forming substrate. As an alternative to heating or combustion, in some cases, volatile compounds may be released by a chemical reaction or by a mechanical stimulus, such as ultrasound. The aerosol-forming substrate may be solid or liquid or may comprise both solid and liquid components. An aerosol-forming substrate may be part of an aerosol-generating article.

As used herein, the term "aerosol-generating article" refers to an article comprising an aerosol-forming substrate that is capable of releasing volatile compounds that can form an aerosol. An aerosol-generating article may be disposable.

As used herein, the term "aerosol-generating device" refers to a device that interacts with an aerosol-forming substrate to generate an aerosol. An aerosol-generating device may interact with one or both of an aerosol-generating article comprising an aerosol-forming substrate, and a cartridge comprising an aerosol-forming substrate. In some examples, the aerosol-generating device may heat the aerosol-forming substrate to facilitate release of volatile compounds from the substrate. An electrically operated aerosol-generating device may comprise an atomiser, such as an electric heater, to heat the aerosol-forming substrate to form an aerosol.

As used herein, the term "aerosol-generating system" refers to the combination of an aerosol-generating device with an aerosol-forming substrate. When the aerosol-forming substrate forms part of an aerosol-generating article, the aerosol-generating system refers to the combination of the aerosol-generating device with the aerosol-generating article. In the aerosol-generating system, the aerosol-forming substrate and the aerosol-generating device cooperate to generate an aerosol.

Below, there is provided a non-exhaustive list of non-limiting examples. Any one or more of the features of these examples may be combined with any one or more features of another example, embodiment, or aspect described herein.

Example A: Heating assembly for an aerosol-generating device, the heating assembly comprising:

a substrate layer, wherein the substrate layer is an electrically isolating substrate layer, and a heating element, wherein the heating element is arranged on a first portion of the substrate layer, wherein the substrate layer comprises a second portion, on which the heating element is not disposed, wherein the substrate layer is rolled into a tubular shape, such that the first portion of the substrate layer is positioned as an inner layer, wherein the second portion of the substrate layer is positioned as an outer layer surrounding the first portion of the substrate layer, and wherein the heating element is arranged between the first portion of the substrate layer and the second portion of the substrate layer.

Example B: Heating assembly according to example A, wherein the substrate layer is flexible.

Example C: Heating assembly according to any of the preceding examples, wherein the substrate layer is provided as a sheet before being rolled into the tubular shape.

Example D: Heating assembly according to any of the preceding examples, wherein the surface area of the second portion is equal to or greater than the surface area of the first portion.

Example E: Heating assembly according to any of the preceding examples, wherein the heating element comprises heating tracks.

Example F: Heating assembly according to any of the preceding examples, wherein the heating element is printed on the first portion of the substrate layer.

Example G: Heating assembly according to any of the preceding examples, wherein the heating element is sandwiched between the first portion of the substrate layer the second portion of the substrate layer.

Example H: Heating assembly according to any of the preceding examples, wherein the first portion of the substrate layer electrically isolates the heating element from the inside of the tube formed by the tubular shaped substrate layer.

Example I: Heating assembly according to any of the preceding examples, wherein the second portion of the substrate layer thermally insulates the heating element from an environment outside of the tube formed by the tubular shaped substrate layer.

Example J: Heating assembly according to any of the preceding examples, wherein the heating assembly comprises only a single substrate layer and no separate thermal insulation layer.

Example K: Heating assembly according to any of the preceding examples, wherein the heating assembly further comprises a heating chamber formed by a tube, wherein the substrate layer is rolled at least twice around the heating chamber, preferably, around the outside of the heating chamber.

Example L: Heating assembly according to example K, wherein the first portion of the substrate layer comprises a first surface and an opposite second surface, wherein the first surface of the first portion of the substrate layer is arranged in direct contact with the heating chamber, and preferably wherein the second surface is in direct contact with the second portion of the substrate layer.

Example M: Heating assembly according to example K or L, wherein one or more of the second portion of the substrate layer and the heating element are arranged distanced from the heating chamber by the first portion of the substrate layer.

Example N: Heating assembly according to any of examples K to M, wherein the circumference of the heating chamber is around half the length of the substrate layer.

Example O: Heating assembly according to any of the preceding examples, wherein the heating assembly further comprises a temperature sensor.

Example P: Heating assembly according to example O, wherein the temperature sensor is arranged on an outer surface of the second portion of the substrate layer.

Example Q: Heating assembly according to example O or P, wherein the temperature sensor is arranged adjacent the heating element and separated from the heating element by the second portion of the substrate layer.

Example R: Heating assembly according to any of the preceding examples, wherein one or both of an adhesive layer and a glue layer is provided on the first portion of the substrate layer opposite the side on which the heating element is arranged.

Example S: Heating assembly according to any of the preceding examples, wherein a heat shrink layer is arranged around the heating assembly when the heating assembly is rolled into the tubular shape Example T: Heating assembly according to example S, wherein the heat shrink layer is made of PEEK.

Example U: Aerosol-generating device comprising a heating assembly according to any of the preceding examples.

Example V: Aerosol generating system comprising an aerosol-generating device according to example U and an aerosol-generating article comprising aerosol-forming substrate.

Features described in relation to one embodiment may equally be applied to other embodiments of the invention.

The invention will be further described, by way of example only, with reference to the accompanying drawings in which.

Figure 1:
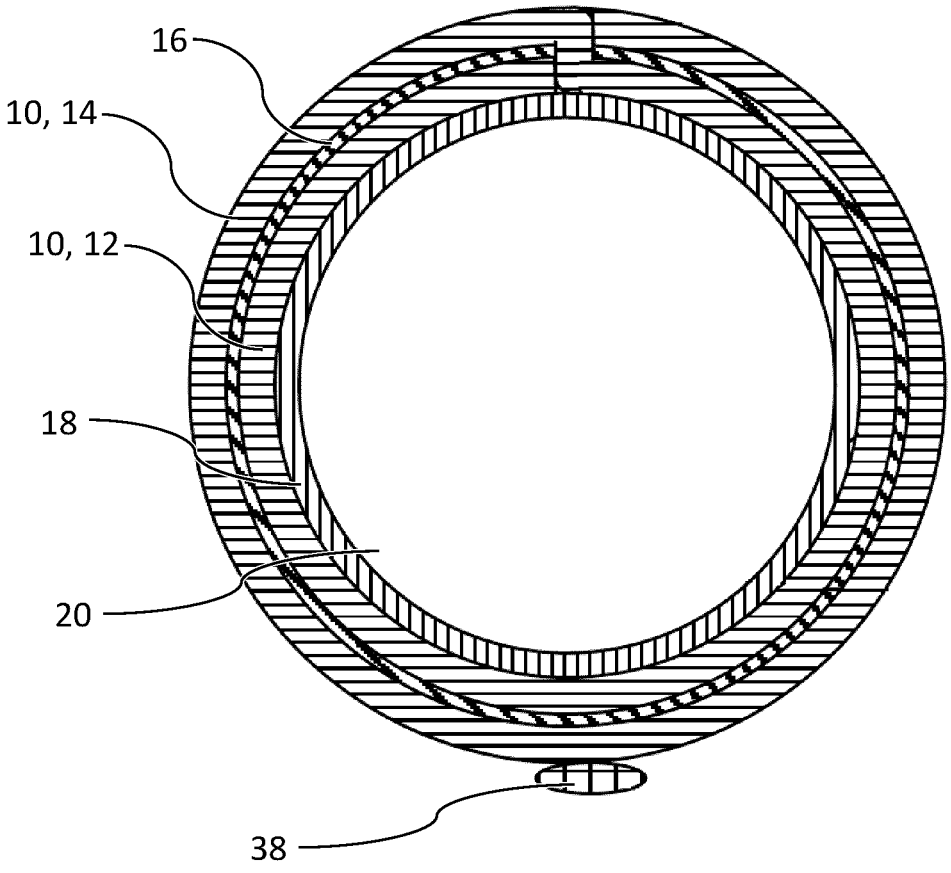
FIG. 1 shows a cross-sectional view of a heating assembly after being rolled into a tubular shape.
Figure 2:
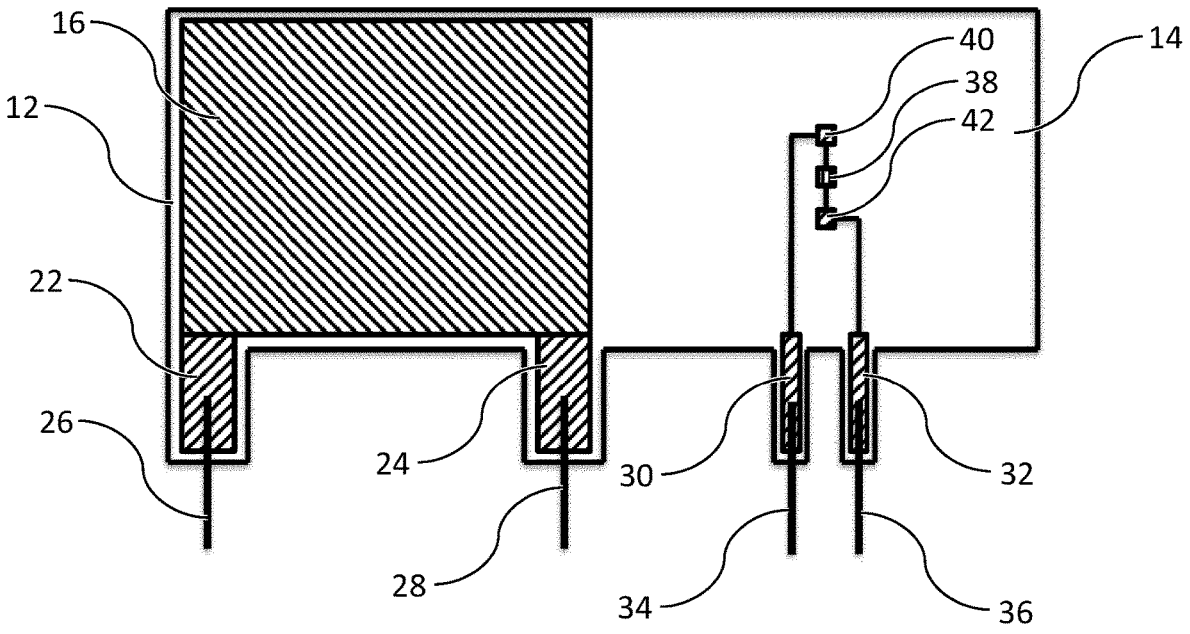
FIG. 2 shows an embodiment of the heating assembly before being rolled into the tubular shape.
Figure 3:
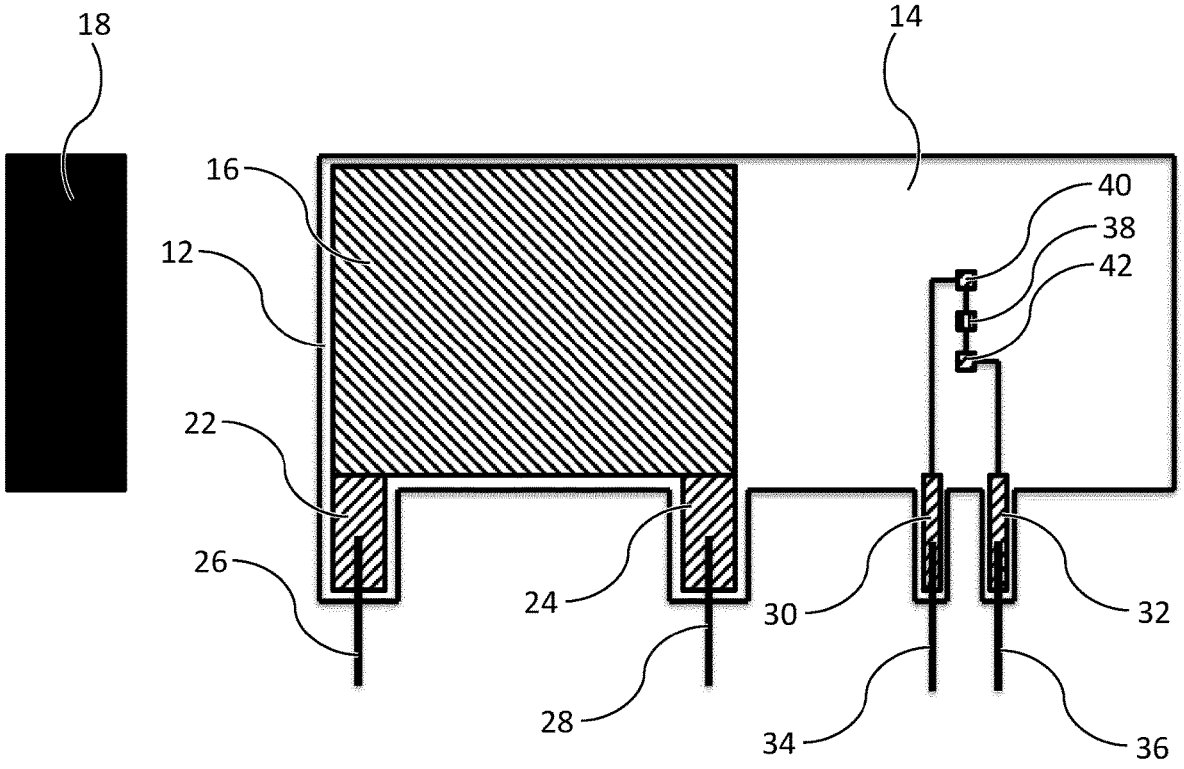
FIG. 3 shows the embodiment of FIG. 2 of the heating assembly before being rolled into the tubular shape together with a tube around which a substrate layer of the heating assembly is wrapped.

FIG. 1 shows a heating assembly. The heating assembly is rolled into a tubular shape. The heating assembly comprises a substrate layer 10. The substrate layer 10 comprises a first portion 12 and a second portion 14. The substrate layer 10 is made from polyimide. The substrate layer 10 is flexible. The substrate layer 10 is initially provided as a sheet as shown in FIGS. 2 and 3 and then rolled into the tubular shape. The substrate layer 10 is rectangular. The length of the substrate layer 10 is around two times the width of the substrate layer 10.

A heating element 16 is arranged on the first portion 12. The heating element 16 is arranged between the first portion 12 of the substrate layer 10 and the second portion 14 of the substrate layer 10 after the heating assembly is rolled into the tubular shape. The heating element 16 is arranged centrally on the first portion 12.

The first portion 12 of the substrate layer 10 is configured rolled or wrapped around a tube 18. The tube 18 forms a heating chamber 20. The heating chamber 20 is the hollow inside of the tube 18. The heating chamber 20 is configured for receiving an aerosol-forming substrate 46, shown in more detail in FIG. 5. During heating of the aerosol-forming substrate 46 in the heating chamber 20 by operation of the heating element 16, an inhalable aerosol is generated. The tube 18 is configured as a hollow cylindrical tube 18. The tube 18 is made from metal. The heating element 16 is arranged on a surface of the first portion 12 of the substrate layer 10 opposite the surface of the first portion 12 of the substrate layer 10 that contacts the tube 18. The first portion 12 of the substrate layer 10 is in direct contact with the tube 18.

A glue layer or adhesive layer may be provided between the first portion 12 of the substrate layer 10 and the tube 18 to improve the connection between the substrate layer 10 and tube 18. A further glue layer or adhesive layer may be provided between the first portion 12 of the substrate layer 10 and the second portion 14 of the substrate layer 10 to improve the connection between the first portion 12 of the substrate layer 10 and the second portion 14 of the substrate layer 10. The first portion 12 of the substrate layer 10 is in direct contact with the second portion 14 of the substrate layer 10 except for the area where the heating element 16 is arranged at. In the area of the first portion 12 of the substrate layer 10 where the heating element 16 is arranged at, the heating element 16 is in direct contact with the second portion 14 of the substrate layer 10.

FIG. 1 further shows a temperature sensor 38. The temperature sensor 38 is a Pt100 or Pt1000 temperature sensor 38. The temperature sensor 38 is arranged on the outside of the second portion 14 of the substrate layer 10, after the second portion 14 of the substrate layer 10 is wrapped around the first portion 12 of the substrate layer 10. The temperature sensor 38 is arranged adjacent the heating element 16 and distanced from the heating element 16 by the thickness of the second portion 14 of the substrate layer 10. The heating element 16 is arranged at the center of the first portion 12 of the substrate layer 10. The temperature sensor 38 is arranged on the second portion 14 of the substrate layer 10 such that the temperature sensor 38 comes to rest next to the heating element 16 after wrapping so as to measure the hottest area of the heating assembly during operation of the heating assembly.

FIG. 2 shows the heating assembly before being wrapped around the tube 18 surrounding the heating chamber 20. As can be seen in FIG. 2, the heating assembly is provided as a sheet. The first portion 12 of the substrate layer 10 is arranged next to the second portion 14 of the substrate layer 10. The heating element 16 is arranged centrally on the first portion 12 of the substrate layer 10. The temperature sensor 38 is arranged on the second portion 14 of the substrate layer 10.

The heating assembly comprises a first heating element contact area 22 and a second heating element contact area 24. The first heating element contact area 22 and the second heating element contact area 24 are arranged on the first portion 12 of the substrate layer 10. The first heating element contact area 22 and the second heating element contact area 24 are electrically connected to the heating element 16. Particularly, the first heating element contact area 22 is provided contacting a first portion of the heating element 16 and the second heating element contact area 24 is provided contacting a second portion of the heating element 16 such that electrical current can be supplied between the first portion of the heating element 16 and the second portion of the heating element 16.

A first electrical contact 26 is provided contacting the first heating element contact area 22. A second electrical contact 28 is provided contacting the second heating element contact area 24. The first heating element contact area 22, the second heating element contact area 24, the first electrical contact 26 and the second electrical contract are provided such that the heating element 16 can be electrically contacted and electric current can be supplied to and through the heating element 16. The supply of electric current is described in conjunction with FIG. 5. The power supply 50 is configured to supply electrical energy to the heating element 16. The controller 52 (also shown in FIG. 5) is configured to contact the temperature sensor 38 and configured to operate the temperature sensor 38 or receive the output of the temperature sensor 38. Operation of the heating assembly by the controller 52 may be controlled by a feedback loop taking into account the output of the temperature sensor 38 or may be controlled using a predetermined lookup table stored in the controller 52 and by comparing, by the controller 52, the output of the temperature sensor 38 with the lookup table.

The heating assembly comprises a first temperature sensor contact area 30 and a second temperature sensor contact area 32. The first temperature sensor contact area 30 and the second temperature sensor contact area 32 are arranged on the second portion 14 of the substrate layer 10. The heating assembly comprises a third electrical contact 34 and a fourth electrical contact 36. The third electrical contact 34 is provided contacting the first temperature sensor contact area 30. The fourth electrical contact 36 is provided contacting the second temperature sensor contact area 32. The first temperature sensor contact area 30, the second temperature sensor contact area 32, the third electrical contact 34 and the fourth electrical contract are provided such that the temperature sensor 38 can be electrically contacted and operated.

In the embodiment shown in FIG. 2, the temperature sensor 38 comprises a third temperature sensor contact area 40 and a fourth temperature sensor contact area 42. The third temperature sensor contact area 40 and the fourth temperature sensor contact area 42 arranged on the second portion 14 of the substrate layer 10 near the temperature sensor 38. The first temperature sensor contact area 30 is electrically connected to the third temperature sensor contact area 40 and the second temperature sensor contact area 32 is electrically connected with the fourth temperature sensor contact area 42.

FIG. 3 shows the heating assembly of FIG. 2 in the state before the heating assembly is wrapped around the tube 18. FIG. 3 further shows the tube 18 arranged next to the heating assembly before the wrapping step. The heating assembly can be wrapped around the tube 18 such that the first portion 12 of the substrate layer 10 on which the heating assembly is arranged is wrapped around the tube 18 initially. Following wrapping the first portion 12 of the substrate layer 10 around the tube 18, the second portion 14 of the substrate layer 10 on which the temperature sensor 38 is arranged is wrapped around the first portion 12 of the substrate layer 10.

Figures 4, 4A, 4B, 4C:
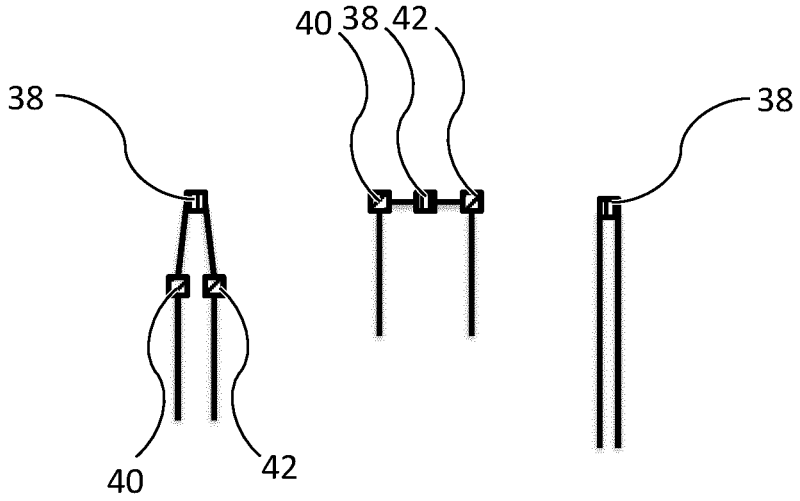
FIG. 4 shows further embodiments of a temperature sensor of the heating assembly.

FIG. 4 shows different embodiments for contacting the temperature sensor 38. In FIG. 4A, the third temperature sensor contact area 40 and the fourth temperature sensor contact area 42 are arranged next to each other and distanced from the temperature sensor 38 in the direction of the third contact and the fourth contact. In contrast, in FIGS. 2 and 3, the third temperature sensor contact area 40 and the fourth temperature sensor contact area 42 are arranged perpendicular to the longitudinal axis of the substrate layer 10 distanced from the temperature sensor 38. As a further option, as shown in FIG. 4B, the third temperature sensor contact area 40 and the fourth temperature sensor contact area 42 are along the longitudinal axis of the substrate layer 10 distanced from the temperature sensor 38. As a final option, shown in FIG. 4C, the temperature sensor 38 is directly contacted with the first temperature sensor contact area 30 and the second temperature sensor contact area 32.

Similar to the contacting of the temperature sensor 38, the heating element 16 can also be contacted differently than shown in FIG. 2 or 3, particularly as shown for the temperature sensor 38.

Figure 5:
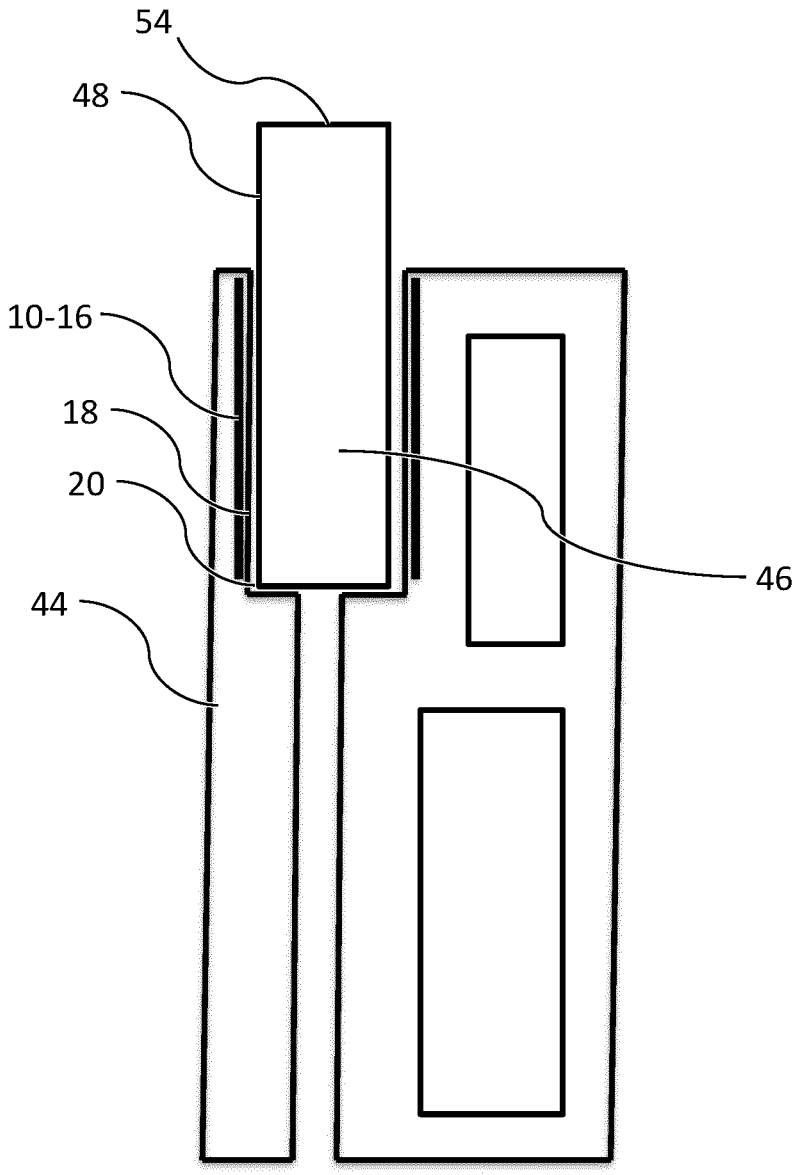
FIG. 5 shows an aerosol-generating system comprising an aerosol-generating device and aerosol-forming substrate provided in an aerosol-generating article.

FIG. 5 shows an aerosol-generating system comprising an aerosol-generating device 44 and an aerosol-forming substrate 46 contained in an aerosol-generating article 48. The heating assembly as described herein is arranged surrounding the tube 18 forming the heating chamber 20 of the aerosol generating device. The aerosol-generating article 48 can be inserted into the heating chamber 20 of the aerosol-generating device 44. The heating assembly can be operated to heat the aerosol-forming substrate 46 of the aerosol-generating article 48. Heating of the aerosol-forming substrate 46 to generate an inhalable aerosol. A user may draw directly on a proximal end 54 of the aerosol-generating article 48. The heating assembly is powered by a power supply 50. The power supply 50 is arranged in the aerosol-generating device 44. The supply of electrical energy from the power supply 50 to the heating assembly is controlled by a controller 52.

The invention claimed is:

1. A heating assembly for an aerosol-generating device, the heating assembly comprising:

a substrate layer, wherein the substrate layer is an electrically isolating substrate layer; and a heating element arranged on a first portion of the substrate layer, wherein the substrate layer comprises a second portion on which the heating element is not disposed, wherein the substrate layer is rolled into a tubular shape, such that the first portion of the substrate layer is positioned as an inner layer, wherein the second portion of the substrate layer is positioned as an outer layer surrounding the first portion of the substrate layer, and wherein the heating element is arranged between the first portion of the substrate layer and the second portion of the substrate layer.

2. The heating assembly according to claim 1, wherein the substrate layer is flexible.

3. The heating assembly according to claim 1, wherein the substrate layer is provided as a sheet before being rolled into the tubular shape.

4. The heating assembly according to claim 1, wherein a surface area of the second portion is equal to or greater than a surface area of the first portion.

5. The heating assembly according to claim 1, wherein the heating element comprises heating tracks.

6. The heating assembly according to claim 1, wherein the heating element is printed on the first portion of the substrate layer.

7. The heating assembly according to claim 1, wherein the first portion of the substrate layer electrically isolates the heating element from an inside of the tube formed by the tubular shaped substrate layer.

8. The heating assembly according to claim 1, further comprising a heating chamber formed by a tube, wherein the substrate layer is rolled at least twice around the heating chamber.

9. The heating assembly according to claim 8, wherein the first portion of the substrate layer comprises a first surface and an opposite second surface, and wherein the first surface of the first portion of the substrate layer is arranged in direct contact with the heating chamber.

10. The heating assembly according to claim 9, wherein the second surface is in direct contact with the second portion of the substrate layer.

11. The heating assembly according to claim 1, further comprising a heating chamber formed by a tube, wherein the substrate layer is rolled at least twice around an outside of the heating chamber.

12. The heating assembly according to claim 1, further comprising a temperature sensor.

13. The heating assembly according to claim 12, wherein the temperature sensor is arranged on an outer surface of the second portion of the substrate layer.

14. The heating assembly according to claim 12, wherein the temperature sensor is arranged adjacent the heating element and separated from the heating element by the second portion of the substrate layer.

15. The heating assembly according to claim 12, wherein the temperature sensor is arranged adjacent the heating element and separated from the heating element by the second portion of the substrate layer after the first portion of the substrate layer is rolled into the tubular shape and the second portion of the substrate layer is rolled around the first portion of the substrate layer.

16. The heating assembly according to claim 1, wherein a heat shrink layer is arranged around the heating assembly when the heating assembly is rolled into the tubular shape.

17. The heating assembly according to claim 16, wherein the heat shrink layer is made of PEEK.

18. An aerosol-generating device comprising a heating assembly according to claim 1.

19. An aerosol-generating system comprising an aerosol-generating device according to claim 18 and an aerosol-generating article comprising an aerosol-forming substrate.

* * * * *